US007775572B2

(12) United States Patent
Slack

(10) Patent No.: US 7,775,572 B2
(45) Date of Patent: Aug. 17, 2010

(54) GRIPPING TOOL WITH FLUID GRIP ACTIVATION

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 12/332,247

(22) Filed: Dec. 10, 2008

(65) Prior Publication Data

US 2009/0146441 A1 Jun. 11, 2009

Related U.S. Application Data

(60) Provisional application No. 61/012,730, filed on Dec. 10, 2007.

(51) Int. Cl.
*E21B 19/10* (2006.01)

(52) U.S. Cl. ..... 294/86.15

(58) Field of Classification Search ..... 294/86.15, 294/86.1, 86.14; 166/85.5
See application file for complete search history.

(56) References Cited

U.S. PATENT DOCUMENTS

| | | | | |
|---|---|---|---|---|
| 3,936,089 | A * | 2/1976 | Hoffmeister | 294/86.4 |
| 4,368,911 | A * | 1/1983 | Pringle | 294/86.15 |
| 5,639,135 | A * | 6/1997 | Beeman | 294/86.25 |
| 6,095,583 | A * | 8/2000 | Beeman et al. | 294/86.15 |
| 6,309,002 | B1 * | 10/2001 | Bouligny | 294/86.25 |

FOREIGN PATENT DOCUMENTS

| | | | |
|---|---|---|---|
| CA | 1242972 | A | 10/1988 |
| CA | 1285474 | C | 7/1991 |
| CA | 1299166 | C | 4/1992 |
| CA | 2271810 | A1 | 5/1998 |
| CA | 2286957 | A1 | 4/2000 |
| CA | 2345244 | A1 | 4/2000 |
| CA | 2399786 | A1 | 8/2001 |
| CA | 2301963 | A1 | 9/2001 |
| CA | 2427453 | A1 | 6/2002 |
| CA | 2122622 | C | 8/2004 |
| CA | 2469971 | A1 | 12/2004 |
| WO | 2006/116870 | A1 | 11/2006 |

* cited by examiner

*Primary Examiner*—Paul T Chin
(74) *Attorney, Agent, or Firm*—Christensen O'Connor Johnson Kindness PLLC

(57) ABSTRACT

A gripping tool has at least one body, including an associated load adaptor adapted to be connected to and interact with one of a drive head or reaction frame. A gripping assembly, carried by the body, has a grip surface adapted to move from a retracted position to an engaged position to radially engage one of an interior surface or an exterior surface of a work piece upon relative axial displacement of the body relative to the grip surface in at least one axial direction. A fluid activated grip activation assembly acts between the at least one body and the grip surface. Axial movement of the load adaptor displaces fluid into a fluid chamber between the at least one body and the grip surface to create relative axial displacement of the at least one body relative to the grip surface.

6 Claims, 4 Drawing Sheets

GRIPPING TOOL WITH FLUID GRIP ACTIVATION

FIELD OF THE INVENTION

This invention relates generally to applications where tubulars and tubular strings must be gripped, handled and hoisted with a tool connected to a drive head or reaction frame to enable the transfer of both axial and torsional loads into or from the tubular segment being gripped. In the field of earth drilling, well construction and well servicing with drilling and service rigs this invention relates to slips, and more specifically, on rigs employing top drives, applies to a tubular running tool that attaches to the top drive for gripping the proximal segment of tubular strings being assembled into, deployed in or removed from the well bore. This tubular running tool supports various functions necessary or beneficial to these operations including rapid engagement and release, hoisting, pushing, rotating and flow of pressurized fluid into and out of the tubular string.

BACKGROUND

Until recently, power tongs were the established method used to run casing or tubing strings into or out of petroleum wells, in coordination with the drilling rig hoisting system. This power tong method allows such tubular strings, comprised of pipe segments or joints with mating threaded ends, to be relatively efficiently assembled by screwing together the mated threaded ends (make-up) to form threaded connections between sequential pipe segments as they are added to the string being installed in the well bore; or conversely removed and disassembled (break-out). But this power tong method does not simultaneously support other beneficial functions such as rotating, pushing or fluid filling, after a pipe segment is added to or removed from the string, and while the string is being lowered or raised in the well bore. Running tubulars with tongs also typically requires personnel deployment in relatively higher hazard locations such as on the rig floor or more significantly, above the rig floor, on the so called 'stabbing boards'. The advent of drilling rigs equipped with top drives has enabled a new method of running tubulars, and in particular casing, where the top drive is equipped with a so called 'top drive tubular running tool' or 'top drive tubular running tool' to grip and perhaps seal between the proximal pipe segment and top drive quill. (It should be understood here that the term top drive quill is generally meant to include such drive string components as may be attached thereto, the distal end thereof effectively acting as an extension of the quill.) Various devices to generally accomplish this purpose of 'top drive casing running' have therefore been developed. Using these devices in coordination with the top drive allows rotating, pushing and filling of the casing string with drilling fluid while running, thus removing the limitations associated with power tongs. Simultaneously, automation of the gripping mechanism combined with the inherent advantages of the top drive reduces the level of human involvement required with power tong running processes and thus improves safety.

In addition, to handle and run casing with such top drive tubular running tools, the string weight must be transferred from the top drive to a support device when the proximal or active pipe segments are being added or removed from the otherwise assembled string. This function is typically provided by an 'annular wedge grip' axial load activated gripping device that uses 'slips' or jaws placed in a hollow 'slip bowl' through which the casing is run, where the slip bowl has a frusto-conical bore with downward decreasing diameter and is supported in or on the rig floor. The slips then acting as annular wedges between the pipe segment at the proximal end of the string and the frusto-conical interior surface of the slip bowl, tractionally grip the pipe but slide or slip downward and thus radially inward on the interior surface of the slip bowl as string weight is transferred to the grip. The radial force between the slips and pipe body is thus axial load self-activated or 'self-energized', i.e., considering tractional capacity the dependent and string weight the independent variable, a positive feedback loop exists where the independent variable of string weight is positively fed back to control radial grip force which monotonically acts to control tractional capacity or resistance to sliding, the dependent variable. Similarly, make-up and break-out torque applied to the active pipe segment must also be reacted out of the proximal end of the assembled string. This function is typically provided by tongs which have grips that engage the proximal pipe segment and an arm attached by a link such as a chain or cable to the rig structure to prevent rotation and thereby react torque not otherwise reacted by the slips in the slip bowl. The grip force of such tongs is similarly typically self-activated or 'self-energized' by positive feed back from applied torque load.

In general terms, an embodiment of the "Gripping Tool" of WIPO Patent Application PCT/CA2006/000710 may be summarized as a gripping tool which includes a body assembly, having a load adaptor coupled for axial load transfer to the remainder of the body, or more briefly the main body, the load adaptor adapted to be structurally connected to one of a drive head or reaction frame, a gripping assembly carried by the main body and having a grip surface, which gripping assembly is provided with activating means to move from a retracted position to an engaged position to radially tractionally engage the grip surface with either an interior surface or exterior surface of a tubular work piece in response to relative axial movement or stroke of the main body in at least one direction, relative to the grip surface. A linkage is provided acting between the body assembly and the gripping assembly which, upon relative rotation in at least one direction of the load adaptor relative to the grip surface, results in relative axial displacement of the main body with respect to the gripping assembly to move the gripping assembly from the retracted to the engaged position in accordance with the action of the activating means.

This gripping tool thus utilizes a mechanically activated grip mechanism that generates its gripping force in response to axial load or stroke activation of the grip assembly, which activation occurs either together with or independently from, externally applied axial load and externally applied torsion load, in the form of applied right or left hand torque, which loads are carried across the tool from the load adaptor of the body assembly to the grip surface of the gripping assembly, in tractional engagement with the tubular work piece.

The grip surface of prior art gripping tools are generally comprised of a coarse profiled and hardened surface typical of tong dies known to the art, where such dies are designed to be sufficiently "sharp" so as to provide a consistent and reliable tractional engagement with the work piece for a gripping tool's grip ratio. Where grip ratio is defined as the normal force (radial load for tubulars) acting between the grip surface and the work piece divided by the magnitude of the shear force (arising from applied hoisting and torsional loads) and by definition must exceed the inverse of the effective coefficient of friction existing between the grip surface and the work piece to prevent slippage. "Sharper" dies, with less contact area, generally penetrate the work piece at lower normal forces providing a higher effective friction coefficient at the correlative lower hoisting load than "duller" dies but this has the side effect of causing greater indentation depth at greater loads leaving localized regions of plastic deformation on the surface of the work piece which are undesirable in certain applications.

As grip surfaces wear the die tooth tips become more rounded and the tooth tip area increases such that the effective coefficient of friction tends to decrease (at the same normal stress). In addition, work pieces with hardened, inconsistent, or coated surfaces offer reduced coefficient and require a tool with a higher grip ratio or a more aggressive grip surface to safely run. Similarly a higher grip ratio is typically required at lower magnitudes of normal force. The present invention is directed to this need.

SUMMARY

In general terms the present invention is an improved gripping tool of the type generally described in PCT/CA2006/000710, with the improvement comprising the incorporation of one or more features to enhance the tool's grip ratio over some or all of the range of applied axial or torsional loads.

There is provided a gripping tool having at least one body including an associated load adaptor adapted to be connected to and interact with one of a drive head or reaction frame the load adaptor being axially movable relative to the body and further arranged with means to displace fluid correlative with this axial movement in the manner of a hydraulic or fluid actuator. A gripping assembly, carried by the at least one body, has at least one grip surface adapted to move from a retracted position to an engaged position to radially engage one of an interior surface or an exterior surface of a work piece upon relative axial displacement of the at least one body relative to the grip surface in at least one axial direction. A fluid activated grip activation assembly having an expandable fluid chamber or actuator that acts between the at least one body and the gripping assembly to apply an axial force tending to cause axial displacement of the at least one body relative to the grip assembly. The grip activation assembly is triggered or driven by fluid displacement caused by axial movement of the load adaptor relative to the at least one body under application of applied axial loads, axial movement of the load adaptor thus displacing fluid into the fluid chamber of the grip activation assembly and correlatively increasing the grip ratio of radial engagement force of the grip surface relative to applied axial load.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

Internally Gripping (Internal Grip) Tubular Running Tool with Internally Reacted Axial Load Compensator.

DESCRIPTION OF THE PREFERRED EMBODIMENTS

General Principles

Figure 1:
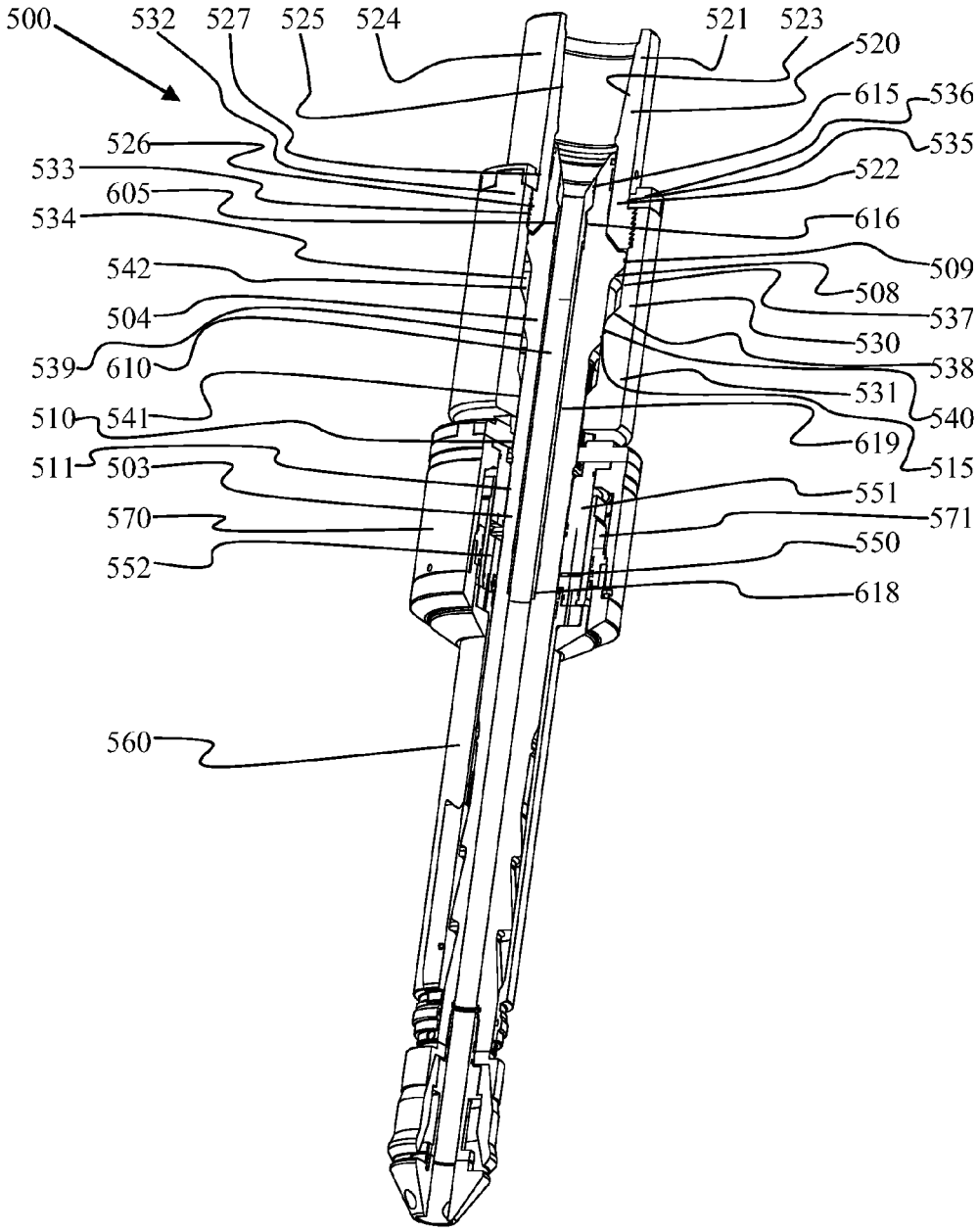
FIG. 1 is a partial cutaway trimetric view of an internal gripping tubular running tool provided with an internal bi-axially activated wedge grip mechanism and an internally reacted axial load compensator in its base configuration architecture (latched w/o casing).

The gripping tool described in PCT patent application CA 2006/00710, is comprised of three main interacting components or assemblies: 1) a body assembly, 2) a gripping assembly carried by the body assembly, and 3) a linkage acting between the body assembly and gripping assembly. The body assembly generally provides structural association of the tool components and includes a load adaptor by which load from a drive head or reaction frame is transferred into or out of the remainder of the body assembly or the main body. The gripping assembly, has a grip surface, is carried by the main body of the body assembly and is provided with means to radially stroke or move the grip surface from a retracted to an engaged position in response to relative axial movement, or axial stroke, to radially and tractionally engage the grip surface with a work piece. The gripping assembly thus acts as an axial load or axial stroke activated grip element.

The main body is coaxially positioned with respect to the work piece to form an annular space in which the axial stroke activated gripping assembly is placed and connected to the main body. The grip surface of the gripping assembly is adapted for conformable, circumferentially distributed and collectively opposed, tractional engagement with the work piece. The means to radially stroke the gripping surface carried by the gripping assembly is configured to link relative axial displacement, or axial stroke, in at least one axial direction, into radial displacement or radial stroke of the grip surface against the work piece with correlative axial and collectively opposed radial forces then arising such that the radial grip force at the grip surface enables reaction of applied axial load and torque into the work piece, where the distributed radial grip force is internally reacted, which arrangement comprises an axial load activated grip mechanism where axial load is carried between the drive head or reaction frame and work piece; the load adaptor, main body and grip element, generally acting in series.

The linkage acting between the body assembly and gripping assembly is adapted to link relative rotation between the load adaptor and grip surface into axial stroke of the gripping assembly and hence radial stroke of the grip surface. The axial load activated grip mechanism is thus arranged to allow relative rotation between one or both of axial load carrying interfaces between the load adaptor and main body or main body and grip element which relative rotation is limited by at least one rotationally activated linkage mechanism which links relative rotation between the load adaptor and grip surface into axial stroke of the grip element and hence radial stroke of the grip surface. The linkage mechanism or mechanisms may be configured to provide this relationship between rotation and axial stroke in numerous ways such as with pivoting linkage arms or rocker bodies acting between the body assembly and gripping assembly but can also be provided in the form of cam pairs acting between the grip element and at least one of the main body or load transfer adaptor to thus readily accommodate and transmit the axial and torsional loads causing, or tending to cause, rotation and to promote the development of the radial grip force. The cam pairs, acting generally in the manner of a cam and cam follower, having contact surfaces are arranged in the preferred embodiment to link their combined relative rotation, in at least one direction, into axial stroke of the grip element in a direction tending to tighten the grip, which axial stroke thus has the same effect as and acts in combination with axial stroke induced by axial load carried by the grip element. Application of relative rotation between the drive head or reaction frame and grip surface in contact with the work piece, in at least one direction, thus causes radial stroke or radial displacement of the grip surface into engagement with the work piece with correlative axial, torque and radial forces then arising such that the radial grip force at the grip surface enables reaction of torque into the work piece, which arrangement comprises torsional load activation so that together with the said axial load activation, the grip mechanism is self-activated in response to bi-axial combined loading in at least one axial and at least one tangential or torsional direction.

The axial load activated grip mechanism of the gripping tool can be provided with another means to apply internally reacted axial force and relative axial movement to the grip surface using a biasing spring. The axially oriented activation spring can be configured in numerous ways such as a Belleville washer stack or coil spring acting between the gripping assembly and the main body but can also be provided in the form of an air spring such that the pressure in the spring forces the grip assembly to move axially relative to the main body and the resulting load is internally reacted through the main body.

Additionally, according to the teaching the present invention this air spring mechanism can be configured in the improved gripping tool such that the pressure in the spring is variable, and a mechanism can be provided such that this pressure can be varied automatically correlative with axial load. In brief, a stroke or axial force activated grip mechanism, where the axial component of stroke causes radial movement of the grip surface into tractional engagement with the work piece, provides a work piece gripping force correlative with axial force, which tractionally resists shear displacement or sliding between the work piece and the gripping surface. The tool provides a further rotation or torque activated linkage acting to stroke the grip surface in response to relative rotation induced by torque load carried across and reacted within the tool in at least one rotational direction, which rotation or torque induced stroke is arranged to have an axial component that causes the radial movement of the grip surface with correlative tractional engagement of the work piece and gripping force internally reacted between the work piece and grip mechanism structure. An axially oriented air spring provides an axial force between the main body and the grip assembly, which is reacted internally in the main body, a mechanism is provided so that the pressure in the gas spring can be varied correlative to axial load. Also a volume of liquid can be added to the gas spring chamber to modify the load response of the gas spring and resulting improvement in grip ratio as desired.

All of the embodiments of improved gripping tools subsequently described are defined by a single configuration architecture, where the term configuration architecture refers to the arrangement of the cams. It is understood that any of the improvements of the present invention can be applied to a gripping tool with any of the seven (7) cam architectures described in detail in PCT/CA2006/000710, now in the US national phase under U.S. patent application Ser. No. 11/912,656, filed Oct. 25, 2007.

Internal Gripping Tubular Running Tool with Load Compensated Spring Activation

This bi-axially activated internally gripping tubular running tool is configured to have a load compensating spring activator. This embodiment is illustrated in FIGS. 1 through 4 as an internal gripping bi-axially activated tubular running tool employing spring activation architecture and a single cam pair base configuration architecture characterized and generally designated by the numeral 500. Referring now to FIG. 1 where the tool 500 is shown in a trimetric partially sectioned view as it appears retracted and configured to insert into a tubular work piece.

Figure 3:
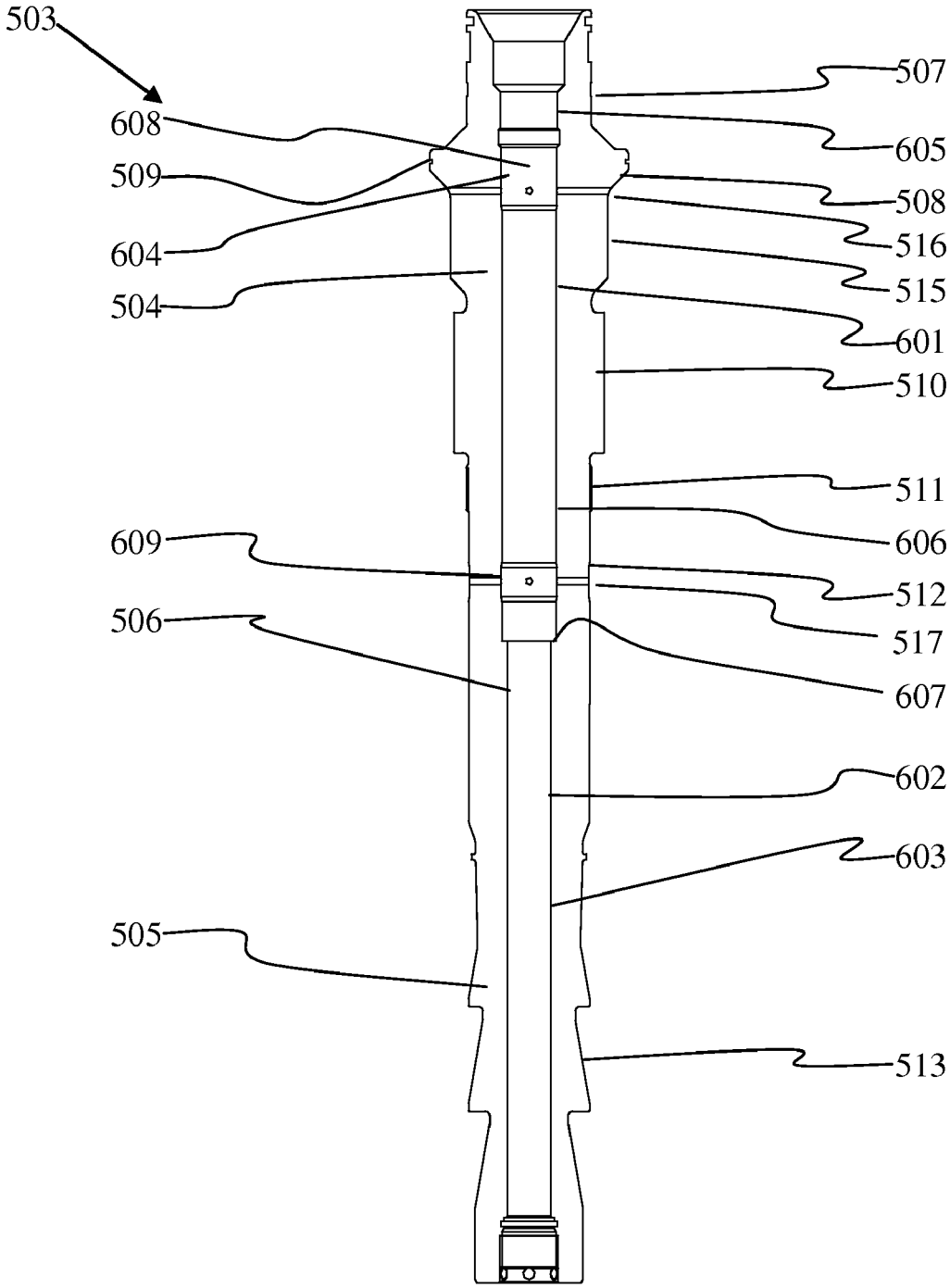
FIG. 3 is a cross-sectional view of the mandrel of the tubular running tool shown in FIG. 1 and FIG. 2.

Referring still to FIG. 1, tubular running tool 500 is shown in the set position; having an elongate mandrel 503, which in this configuration functions as the main body. Referring now to FIG. 3, mandrel 503 has upper end 504, lower end 505, and bore 506, with generally cylindrical interval 507 at upper end 504. Below the cylindrical interval is an external upset load shoulder interval 508 with seal element 509 located at the major diameter in this interval. In this case the external upset load shoulder interval 508 is shown as a dual ramp surface. Below shoulder interval 508 on mandrel 503 is cylindrical interval 515, followed by splined interval 510, load thread interval 511, cylindrical interval 512, and wedge grip ramp interval 513. Wedge grip ramp interval 513 at the lower end 505 of mandrel 503 consists on a plurality of frusto-conical ramp surfaces, in this case three (3), arranged such that they taper outward toward the bottom of mandrel 503. Mandrel 503 includes a plurality of upper and lower fluid ports 516 and 517 respectively, in this case four of each, which hydraulically connect cylindrical interval 515 and with cylindrical interval 512 on the exterior of mandrel 503 with bore 506, and are arranged such that they are oriented radially with respect to the mandrel axis. Referring still to FIG. 3, internal bore 506 of mandrel 503 has upper end 601 and generally straight cylindrical section 602 at lower end 603. Upper end 601 of bore 506 consists of smooth seal surface 604, thread element 605, smooth bore section 606 and upward facing shoulder 607. Fluid ports 516 and 517 intercept increased diameter sections 608 and 609 respectively.

Figure 4:
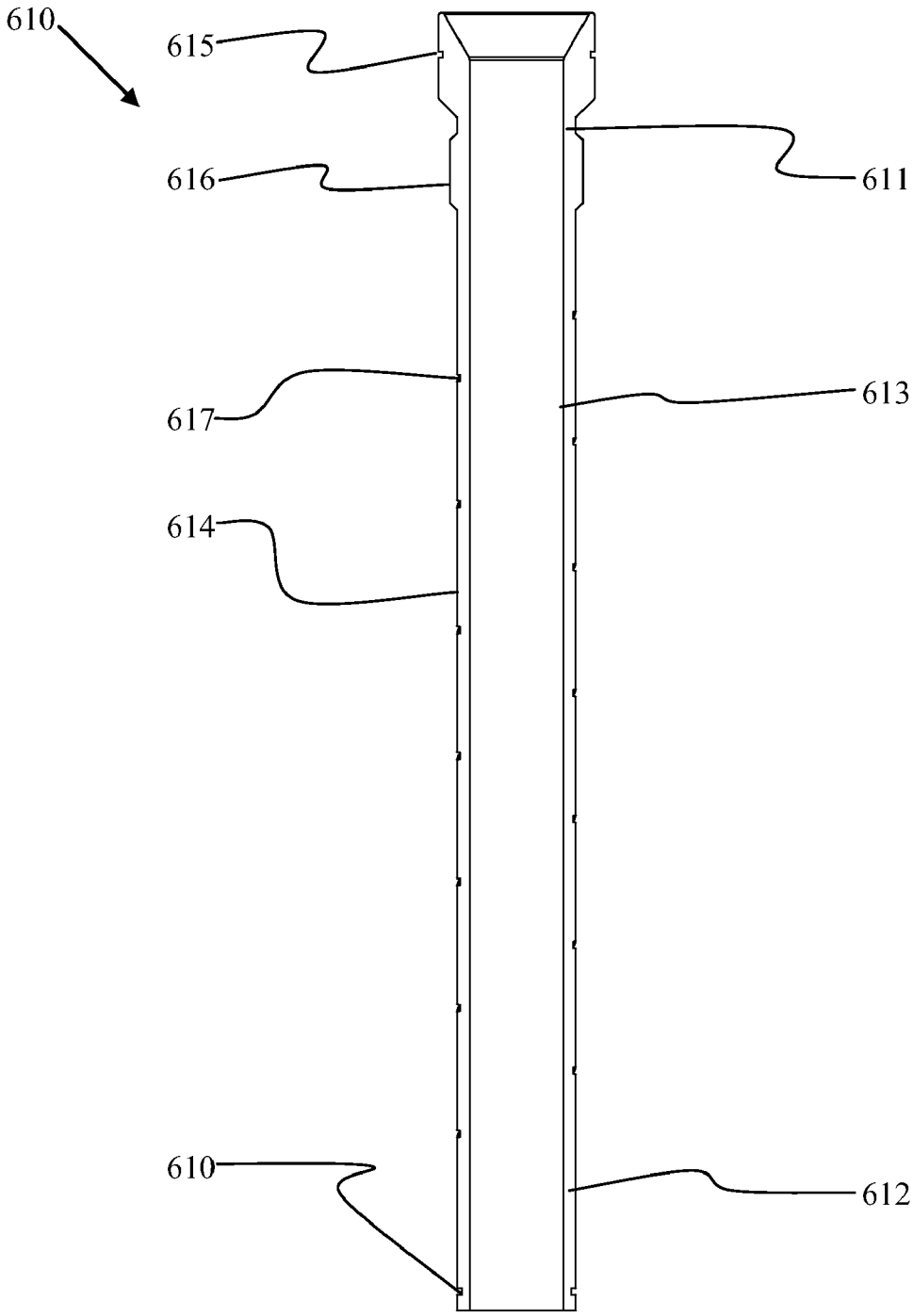
FIG. 4 is a cross-sectional view of the fluid sleeve of the tubular running tool shown in FIG. 1 and FIG. 2.

Referring now to FIG. 4 which shows a cross section view of fluid sleeve 610 with upper end 611, lower end 612, smooth internal bore 613 and profiled outer surface 614. Outer surface 614 of fluid sleeve 610 has seal element 615, thread element 616, helical fluid path 617 and seal element 618.

Referring now to FIG. 1, fluid sleeve 610 is assembled with mandrel 503 such that thread element 605 of mandrel 503 engages with thread element 616 of fluid sleeve 610. Seal element 615 and 618 engage with surfaces 604 and 606 respectively forming sealed helical cavity 619.

Referring still to FIG. 1, tubular running tool 500 is provided with upper nubbin 520 with upper end 521, lower end 522, through bore 523 and external surface 524, has load adaptor 525 at upper end 521 and thread element 526 and spline interval 527 on external surface 524 at lower end 522. Torque sleeve 530 with lower end 531 and upper end 532 is arranged coaxially with and external to the upper end 504 of mandrel 503. Upper end 532 of torque sleeve 530 has thread element 533 on internal surface 534 which threadingly engages with thread element 526 on upper nubbin 520 to restrict relative axial movement and splined interval 535 assembled with lock ring 536 which engages spline interval 527 on upper nubbin 520 as well to restrict relative circumferential movement. Below thread element 533 is cylindrical interval 537, internally upset load shoulder 538, cylindrical interval 539 containing seal element 540, and splined interval 541. Seal element 540 on cylindrical interval 539 of torque sleeve 530 slidingly and sealingly engages with cylindrical interval 515 on mandrel 503, and seal element 509 on load shoulder 508 slidingly and sealingly engages cylindrical interval 537 of torque sleeve 530, this combination of sliding and sealing elements combine to form compensator fluid chamber 542, which changes in volume with relative axial movement between the torque sleeve upper nubbin assembly and the mandrel 503.

Figure 2:
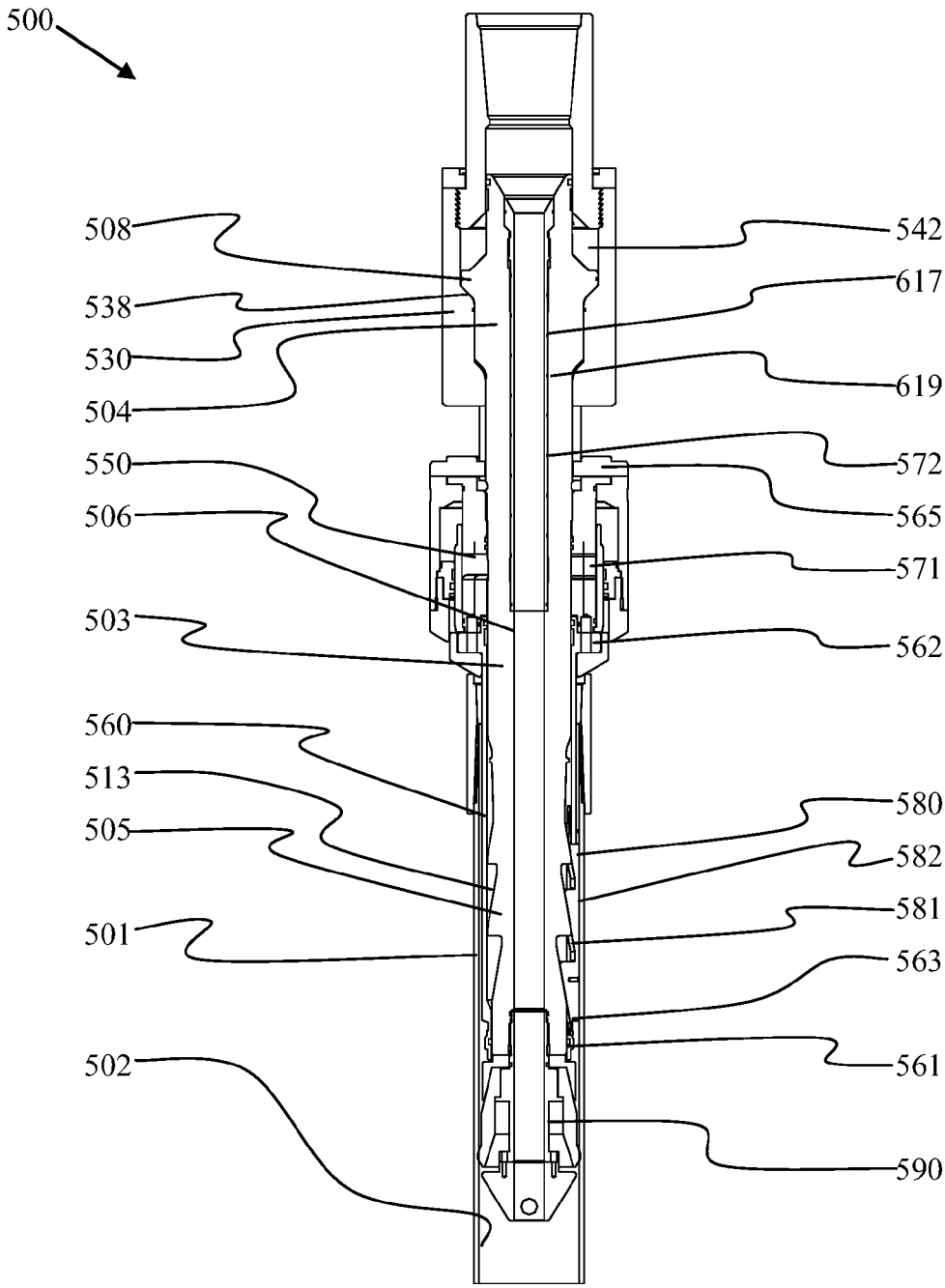
FIG. 2 is a cross-sectional view of the tubular running tool shown in FIG. 1, as it appears set on the proximal end of a threaded and coupled segment of casing with the internally reacted axial load compensator partially activated.

Referring still to FIG. 1, also included with tubular running tool 500 is cam pair 550 consisting of upper cam ring 551 and lower cam ring 552. Upper cam ring is rigidly connected to mandrel via load thread 511 and spline interval 510 with Lock Ring 565. Lower cam ring 552 is rigidly connected to cage 560. Collectively cam pair 550 is assembled coaxially with and enclosed by cam housing assembly 570 forming internal sealed spring fluid chamber 571 with a volume that varies with relative axial movement of cam pair 550 relative to one another. Referring now to FIG. 2, fluid chamber 571 is hydraulically connected to fluid chamber 542 by fluid ports 516 and 517 (not shown) and helical cavity 619 and collectively form fluid system 572. Cage 560 is generally cylindrical in shape with elongate lower end 561 and flanged upper end 562. Lower end 561 of cage 560 has a plurality of radially oriented windows 563, in this case five (5) evenly spaced about the circumference. A plurality of jaws 580 are assembled within the windows 563 such that the internal multiple ramp surface 581 slidingly engages with ramp interval 513 on the lower end 505 of mandrel 503 and external surface 582 tractionally engages internal surface 502 of work piece 501.

Referring still to FIG. 2, a bottom end assembly 590 is provided that sealingly engages with the internal surface 502 of work piece 501 and helps to aid insertion of the tool 500 in the proximal end of work piece 501.

Referring again to FIG. 2, application of axial load to tubular running tool 500 causes load shoulder 508 of mandrel 503 and load shoulder 538 of torque sleeve 530 to move closer together. The resulting reduced volume in fluid chamber 542, causes the fluid mixture contained in this chamber to move to fluid chamber 571, which results in an increase in gas spring pressure. This in turn forces cam pair 550 apart and brings grip surface 582 into engagement with internal surface 502 of work piece 501. It will be apparent to one skilled in the art that the mixture of fluid in fluid system 572 can be changed to vary the pressure response of stroking tool 500 and resulting in a change in grip response. Increased fluid pressure increases the grip ratio and decreases the critical gripping friction coefficient under low loads. It is expected that the fluid mixture will consist of certain volume of relatively incompressible fluid in a liquid state and a charge pressure of compressible gas such that the minimum fluid chamber volume greater than the maximum volume of liquid by some amount sufficient to accommodate the gas charge in a compressed state. It will also be apparent to one skilled in the art that the compensator fluid chamber area and stroke along with the spring fluid chamber area and stroke can be changed to vary the pressure and grip response of the tool. As such the volume and velocity of fluid travelling through helical fluid path 617 changes, as does the pressure change in response to the flow resistance of the path. It is understood that while generally the fluid path 617 will be designed such that the flow restriction will be minimal, in may be desirable to provide some additional flow restriction or method of varying such a flow restriction so that advantage can be taken of the dampening characteristics of the flow, and that this dampening can be varied by controlling fluid path length, fluid path size and fluid viscosity.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

I claim:

1. A gripping tool, comprising:

at least one body with an associated load adaptor adapted to be connected to and interact with one of a drive head or reaction frame, the load adaptor being axially movable relative to the body to stroke from a first position toward a second position and correlatively displace fluid from a first fluid chamber;

a gripping assembly carried by the at least one body, having at least one grip surface which moves from a retracted position to an engaged position to radially engage the grip surface with one of an interior surface or an exterior surface of a work piece upon relative axial displacement of the at least one body relative to the grip surface in at least one axial direction; and a fluid activated grip activation assembly, having an expandable second fluid chamber in communication with the first fluid chamber, the expandable second fluid chamber acting between the at least one body and the gripping assembly to apply an axial force correlative with pressure of the fluid in the first and second fluid chambers tending to cause axial displacement of the at least one body relative to the grip surface, the grip activation assembly being triggered by axial movement of the load adaptor relative to the at least one body under application of applied axial loads, axial movement of the load adaptor from the first position toward the second position displacing fluid from the first fluid chamber into the second fluid chamber tending to increase the fluid pressure and correlatively increasing a grip ratio of radial engagement force of the grip surface relative to applied axial load.

2. The gripping tool of claim 1, wherein the fluid activated grip activation assembly includes a compliant member positioned to act between the at least one body and the grip surface and in series with the force correlative with pressure of the fluid in the second fluid chamber.

3. The gripping tool of claim 2, wherein the compliant member acts to compress as fluid is displaced from the first position to the second position of the load adaptor relative to the body to increase the grip ratio over only a lower portion of an applied load range.

4. The gripping tool of claim 2, wherein the compliant member is a spring.

5. The gripping tool of claim 4, wherein the spring is a gas spring of compressible gas contained in a spring fluid chamber.

6. The gripping tool of claim 1, wherein an external fluid source is provided along with means to increase or decrease fluid pressure provided by the external fluid source.

* * * * *